US010400493B2

(12) United States Patent
Gabl

(10) Patent No.: US 10,400,493 B2
(45) Date of Patent: Sep. 3, 2019

(54) ASSEMBLY FOR SPREADING APART AT LEAST TWO HINGEDLY INTERCONNECTED DOOR LEAVES

(71) Applicant: Julius Blum GmbH, Hoechst (AT)

(72) Inventor: Dominik Gabl, Bludenz (AT)

(73) Assignee: JULIUS BLUM GMBH, Hoechst (AT)

( * ) Notice: Subject to any disclaimer, the term of this patent is extended or adjusted under 35 U.S.C. 154(b) by 196 days.

(21) Appl. No.: 15/604,775

(22) Filed: May 25, 2017

(65) Prior Publication Data

US 2017/0260789 A1 Sep. 14, 2017

Related U.S. Application Data

(63) Continuation of application No. PCT/AT2015/000144, filed on Nov. 18, 2015.

(30) Foreign Application Priority Data

Nov. 26, 2014 (AT) ..... A 854/2014

(51) Int. Cl.
*E05D 15/58* (2006.01)
*E05D 15/26* (2006.01)
(Continued)

(52) U.S. Cl.
CPC ..... *E05D 15/58* (2013.01); *E05D 15/264* (2013.01); *E05F 1/10* (2013.01); *E05F 1/1025* (2013.01); *E05F 11/54* (2013.01); *E06B 3/5009* (2013.01); *E06B 3/509* (2013.01); *E06B 3/5072* (2013.01); *E06B 5/006* (2013.01); *E06B 7/28* (2013.01); *E05Y 2900/212* (2013.01)

(58) Field of Classification Search
CPC ..... E05D 15/58; E05D 15/264; E05F 1/10; E05F 1/1025; E05F 11/54
See application file for complete search history.

(56) References Cited

U.S. PATENT DOCUMENTS 577,593 A 2/1897 Bronson et al.
2,290,219 A * 7/1942 Ulfving ..... E05F 1/1246 16/291
(Continued)

FOREIGN PATENT DOCUMENTS

CN 104080992 10/2014
DE 43 08 196 10/1997
(Continued)

OTHER PUBLICATIONS

International Search Report dated Feb. 15, 2016 in International (PCT) Application No. PCT/AT2015/000144.
(Continued)

*Primary Examiner* — Daniel J Rohrhoff
(74) *Attorney, Agent, or Firm* — Wenderoth, Lind & Ponack, L.L.P.

(57) ABSTRACT

An arrangement for spreading apart at least two door leaves which are part of an item of furniture and are hingedly interconnected, from a folded position into a spread-apart position, includes an energy accumulator and a spreading element impinged by the energy accumulator. The spreading element comprises a pivotally supported lever arm with a free end, and a control contour is provided for controlling movement of the spreading element.

23 Claims, 23 Drawing Sheets

(51) Int. Cl.

| | |
|---|---|
| ***E05F 1/10*** | (2006.01) |
| ***E05F 11/54*** | (2006.01) |
| ***E06B 3/50*** | (2006.01) |
| ***E06B 5/00*** | (2006.01) |
| ***E06B 7/28*** | (2006.01) |

(56) References Cited

U.S. PATENT DOCUMENTS

| | | | | |
|---|---|---|---|---|
| 3,270,801 | A * | 9/1966 | Richter | B63B 19/24 114/202 |
| 3,846,868 | A * | 11/1974 | Brydolf | E05F 1/1269 16/255 |
| 4,945,972 | A * | 8/1990 | Takeuchi | E05D 15/264 160/203 |
| 5,131,449 | A * | 7/1992 | Winn | E05D 15/264 160/199 |
| 7,240,974 | B2 | 7/2007 | Hirtsiefer | |
| 7,322,661 | B1 * | 1/2008 | Salvesen | A47B 47/02 292/146 |
| 9,068,386 | B2 | 6/2015 | Ishii et al. | |
| 9,303,443 | B2 * | 4/2016 | Lucas | E04F 10/10 |
| 9,428,950 | B2 | 8/2016 | Braungart | |
| 2004/0239213 | A1 | 12/2004 | Hirtsiefer | |
| 2010/0282418 | A1 * | 11/2010 | Lucas | E04F 10/10 160/54 |
| 2013/0292067 | A1 * | 11/2013 | Lucas | E06B 9/0638 160/213 |
| 2015/0008811 | A1 * | 1/2015 | Ishii | E05D 15/58 312/322 |
| 2015/0084492 | A1 | 3/2015 | Braungart | |

FOREIGN PATENT DOCUMENTS

| | | | | |
|---|---|---|---|---|
| DE | 297 10 854 | | 10/1997 | |
| EP | 0 069 279 | | 1/1983 | |
| EP | 0 433 726 | | 6/1991 | |
| EP | 1 296 011 | | 3/2003 | |
| WO | 2013/114730 | | 8/2013 | |
| WO | WO-2013114730 | A1 * | 8/2013 | E05D 15/58 |
| WO | 2013/173853 | | 11/2013 | |

OTHER PUBLICATIONS

Search Report dated Sep. 28, 2015 in Austrian Application No. A 854/2014, with English translation.

English translation of Chinese Search Report dated Dec. 15, 2017 in corresponding Chinese Application No. 201580064404.

* cited by examiner

ASSEMBLY FOR SPREADING APART AT LEAST TWO HINGEDLY INTERCONNECTED DOOR LEAVES

BACKGROUND OF THE INVENTION

The invention concerns an arrangement for spreading apart at least two door leaves which are part of an item of furniture and are hingedly interconnected, from a folded position into a spread-apart position, comprising an energy accumulator and a spreading element which is impinged by the energy accumulator, wherein the spreading element comprises a pivotally supported lever arm with a free end. Furthermore, the invention concerns an item of furniture, preferably a cabinet, with the arrangement according to the invention.

The EP 0 433 726 B1 describes a generic arrangement in the case of which a lever is biased by means of a spring element and the spring biasing force is used in order to spread apart the two door leaves after the door leaves have been pulled out from the cabinet in their folded position. This solution is disadvantageous because the spring biasing force is released uncontrolled so that the two door leaves are indeed spread apart, however, this movement is effected abruptly. Besides, the two door leaves have to be compressed against the spring biasing force in the case of a movement in the reverse direction, which can be considered to be annoying by a user.

SUMMARY OF THE INVENTION

Thus, the object of the invention is to provide an arrangement which has a significantly improved user comfort in the case of the movement of the two hingedly interconnected door leaves of an item of furniture compared to the state of the art.

According to the invention, thus, a control contour for controlling the movement of the spreading element is provided.

Such a control contour has the big advantage that by its design a predetermined movement sequence of the spreading element can be realized. So it can be possible for example to build the control contour in such a way that the at least two door leaves are—starting from the folded position—initially moved smoothly apart, the acceleration is then increasing and finally a deceleration takes place. In the case of such a movement sequence a user would have the impression of a harmonious transition from the folded position into the spread-apart position. By the control contour, thus, the energy stored in the energy accumulator can be applied dosed onto the spreading element and, thereby, onto the door leaves and an advantageous predetermined movement pattern of the door leaves is realized.

Also in the case of the reverse movement direction from the spread-apart position into the folded position the control contour has proved to be highly advantageous. It is namely possible to construct the control contour in such a way that the at least two door leaves are powerlessly transferred from the spread-apart position into the folded position. This has the advantage that a user in the case of folding the door leaves does not have to work against the energy accumulator as it is the case with the state of the art. Concretely, this can be realized exemplarily in that the control contour comprises a section which is formed circular in relation to a pivot point.

Alternatively thereto, the control contour can be constructed in such a way that starting from the spread-apart position by the spreading element a force can be exerted in the direction of the folded position onto at least one of the at least two door leaves. In this way the folding of the door leaves is even supported by the arrangement. An advantageous technical implementation of this measure is that the control contour comprises a section which is composed of segments, wherein the distances of these segments are getting successively smaller to a pivot point.

The flexibility of the control of the movement of the spreading element can be further increased in that the control contour comprises at least one, preferably pivotally supported, contour lock which acts unidirectional—thus in one direction.

According to an advantageous embodiment of the invention, at least one movable carriage—which is preferably movable along at least one horizontally arranged rail—can be coupled, preferably by means of at least one hinge, with at least one of the at least two door leaves. For the increase of the stability of the coupling, it is favorable if two hinges are provided.

Furthermore, it is favorable if the carriage comprises a supporting contour on which the spreading element can be supported. In this case, the door leaf which is coupled with the carriage contacts the spreading element indirectly by the supporting contour arranged on the carriage.

By the form of the supporting contour the impingement of the spreading element onto the carriage can be designed smoother, for example by means of a sloping surface, and/or a protrusion or the like can be provided, behind which the spreading element engages, whereby both pressure forces and tensile force can be transmitted onto the carriage and, thus, onto the door leaf coupled with the carriage.

An advantageous additional measure is that a movement of the spreading element can be blocked by means of the at least one carriage and wherein the carriage supports itself on a guide, preferably by means of at least one guiding roller.

According to the invention, the spreading element comprises a pivotally supported lever arm with a free end. On this free end, preferably a pivotally supported rolling body is arranged. This rolling body can be for example a cylindrical roller or a sphere.

Advantageous structural measures are further that the spreading element is arranged on a swiveling element which comprises preferably at least one guiding groove for guiding a control pin interacting with the control contour and/or that the spreading element is coupled by means of a toothing with a base, preferably to be attached on a carrier for the at least two door leaves, and wherein the control contour is preferably formed on this base.

Besides, it has proved advantageous if the energy accumulator can be loaded by a movement of the at least two door leaves in the folded position. This means that the energy accumulator is loaded only after the folding of the door leaves and a user does not feel a counteraction when folding the door leaves which would be caused by the loading of the energy accumulator.

For loading the energy accumulator a loading curve for loading the energy accumulator can be provided, the loading curve preferably to be attached on a side wall of the item of furniture, wherein the energy accumulator is coupled with the loading curve, preferably by means of a loading roll.

A technical, easy solution is that the energy accumulator comprises a spring assembly.

For the case that the arrangement is to be employed with an item of furniture which provides a, preferably fully, inserted position in the item of furniture for the at least two door leaves in the folded position, the user comfort can be further improved in that there is provided an ejection device for ejecting the at least two door leaves in the folded position from a, preferably fully, inserted position in the item of furniture into an open position beyond the item of furniture. In the case of such items of furniture the inserted position is usually formed in a, preferably laterally arranged, slot of the item of furniture.

If the arrangement is now comprising such an ejection device, this ejection device initially ensures that the at least two door leaves in their folded position are ejected from the inserted position in the item of furniture into an open position beyond the item of furniture and are subsequently transferred by the spreading element impinged by the energy accumulator from the folded position into a spread-apart position. Subsequently, the user only has to move the door leaves in a closed position, in which the front panels of the door leaves are located in one plane. Then, the item of furniture—provided that the door leaves are covering the whole breadth of the furniture carcass—is fully closed by the door leaves.

As mentioned at the beginning, protection is also sought for an item of furniture, in particular a cabinet, comprising at least two hingedly interconnected door leaves which can be situated at least in a folded position and in a spread-apart position, wherein the item of furniture comprises an arrangement according to the invention for spreading apart the door leaves from the folded position into the spread-apart position.

BRIEF DESCRIPTION OF THE DRAWINGS

Further advantages and details of the invention follow from the drawings, in which:

FIGS. 2*a* to 12 show a first embodiment of the invention, whereas FIGS. 13*a* to 23*b* show a second embodiment of the invention. FIGS. 13*a*, 14*a*, 15*a*, 16*a*, 17*a*, 18*a*, 19*a*, 20*a*, 21*a*, 22*a*, and 23*a* each show a perspective view of the arrangement and FIGS. 13*b*, 14*b*, 15*b*, 16*b*, 17*b*, 18*b*, 19*b*, 20*b*, 21*b*, 22*b*, and 23*b* each show a front view of that part of the arrangement which comprises the energy accumulator, the spreading element and the control contour.

DETAILED DESCRIPTION OF THE INVENTION

Figure 1:
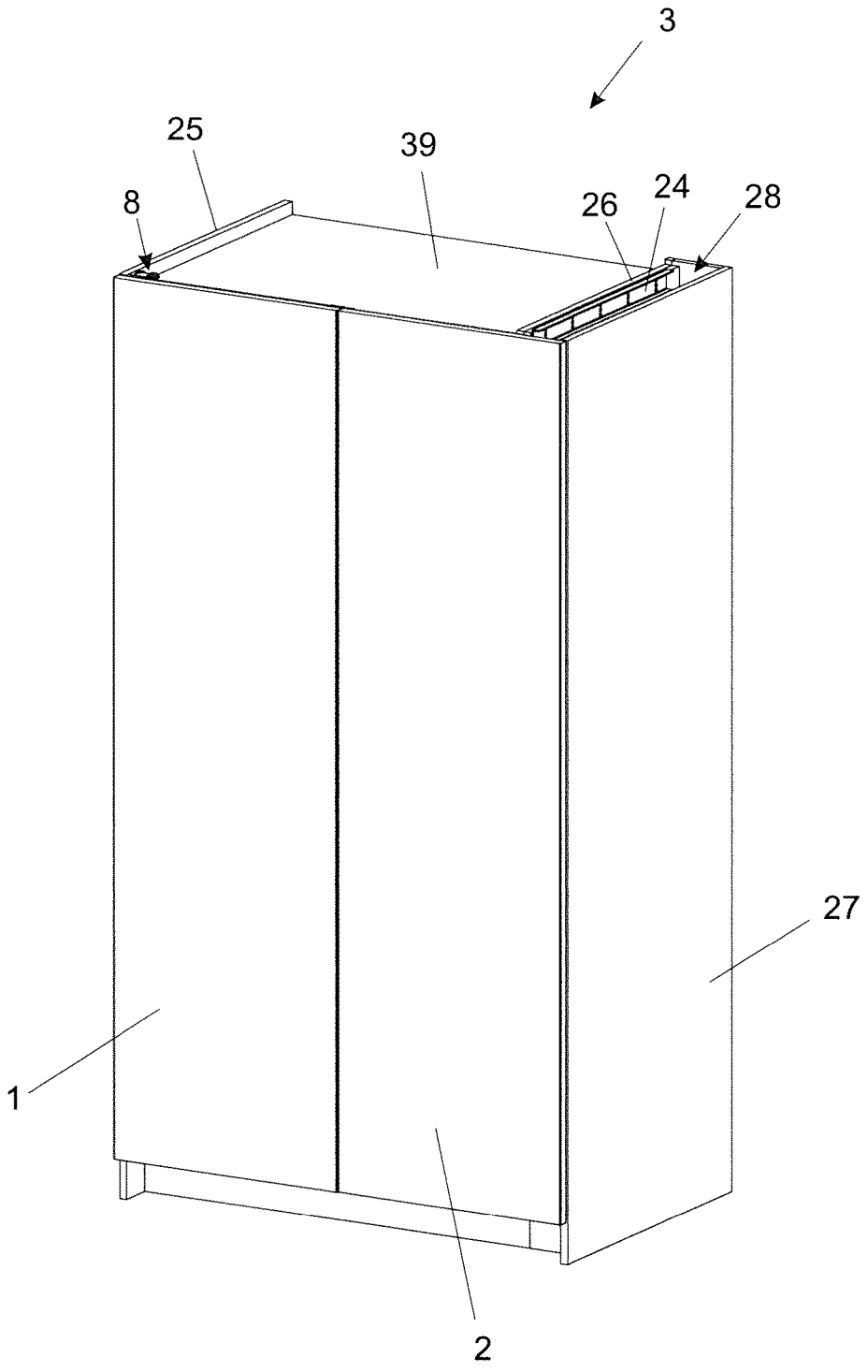
FIG. 1 shows an item of furniture in the form of a cabinet with two door leaves in their closed position.

FIG. 1 shows a perspective view of the item of furniture 3 in the form of a cabinet which comprises a furniture carcass. The furniture carcass comprises several side walls 25, 26 and 27, a cover plate 30, a bottom plate 40 and a back wall 41 (compare FIG. 2*c*).

The side walls 26 and 27 arranged parallel to each other have a small distance compared to the whole breadth of the furniture carcass. The hollow space arranged between these side walls 26 and 27 defines a slot 28 which is arranged laterally on the furniture carcass.

The cabinet 3 can be closed by two hingedly interconnected door leaves 1 and 2. FIG. 1 shows the closed position of the two door leaves 1 and 2 in which the front panels of the door leaves 1 and 2 are arranged in one plane. As is apparent from the drawings, in particular from FIGS. 2*c*, 3*c*, 4*c*, 5*c*, 6*c*, 7*c*, 8*c*, 9*c*, 10*c*, and 11*c*, the door leaves 1 and 2—starting from the closed position—can be initially transferred in a spread-apart position (compare FIGS. 2*c*, 3*c* and 11*c*) and subsequently transferred from the spread-apart position into a folded position (compare FIG. 4*c* to FIG. 10*c*). In this folded position the door leaves 1 and 2 can then be retracted into the slot 28, in fact starting from an open position beyond the item of furniture 3 (compare FIG. 4*c*) via several intermediate positions into a fully inserted position in the item of furniture 3 (compare FIG. 8*c*). In this position the door leaf assembly is completely arranged in the item of furniture 3 so that a user has unhindered access to the interior of the item of furniture 3.

As is apparent from FIG. 1, the door leaves 1 and 2 are formed without handles. For transferring the door leaves 1 and 2 from their closed position into a kinked position—which makes it easier for a user to further open the door leaves—an ejection device can be provided, comprising an energy accumulator and an ejection element being impinged by the energy accumulator. The ejection element can be unlocked by pressing, for example by pressing on one of the door leaves in the area where the door leaves are hingedly interconnected. Then, the ejection element ejects one or both door leaves outward under the effect of the energy accumulator in the area where the two door leaves are hingedly interconnected, so that the door leaves are kinked relative to each other. Alternatively, of course, handles arranged on one or on both door leaves can be provided instead of such an ejection device.

Figure 2A:
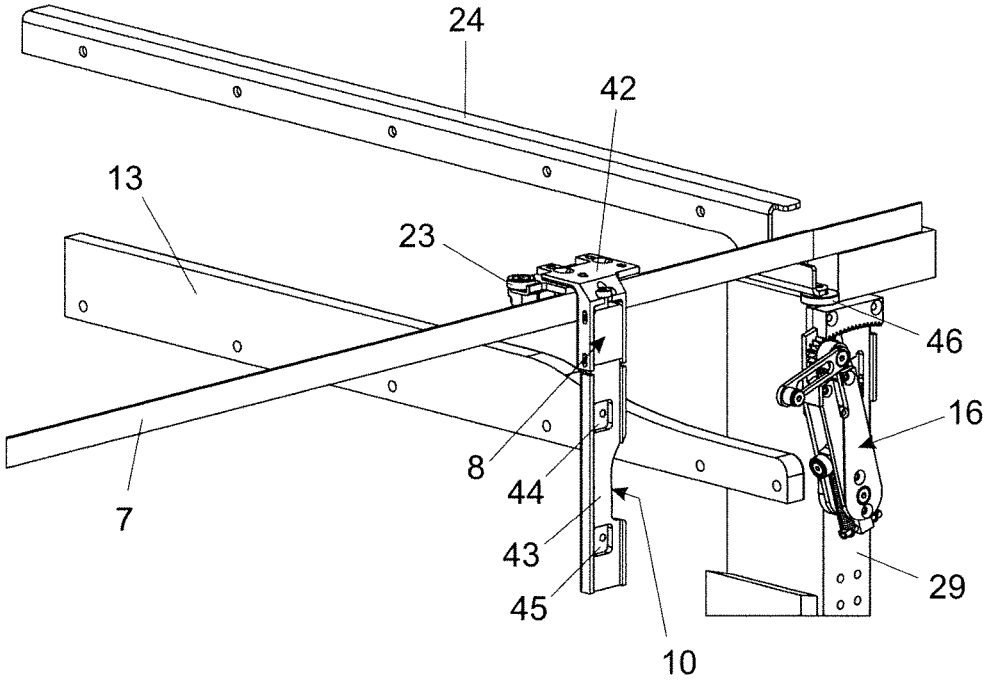
FIGS. 2*a* to 11*c* each show the position of the door leaves in relation to the item of furniture, with FIGS. 2*a*, 3*a*, 4*a*, 5*a*, 6*a*, 7*a*, 8*a*, 9*a*, 10*a*, and 11*a* each showing a perspective view of the substantial parts of the present arrangement and FIGS. 2*b*, 3*b*, 4*b*, 5*b*, 6*b*, 7*b*, 8*b*, 9*b*, 10*b*, and 11*b* each showing a front view of that part which comprises the energy accumulator, the spreading element and the control contour.
Figure 2B:
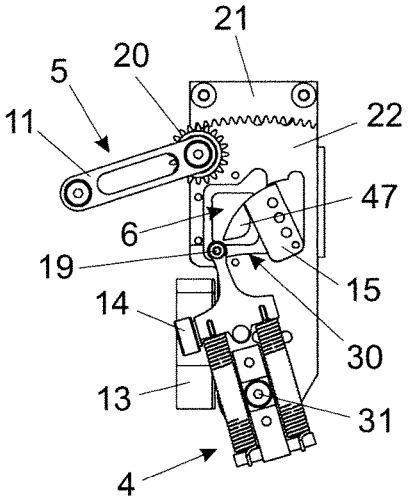
Figure 2C:
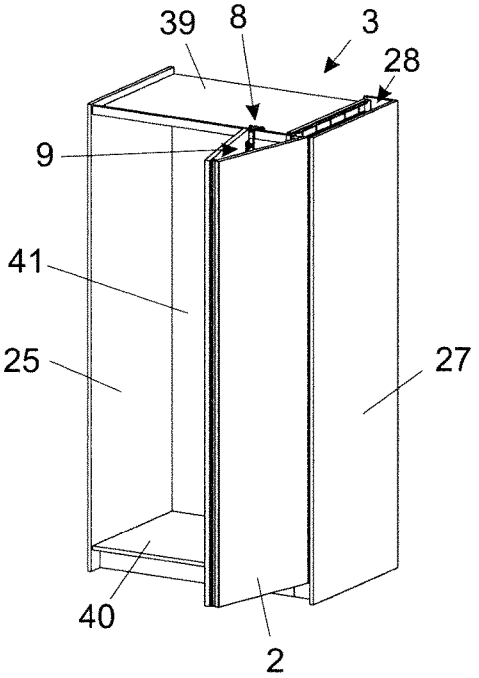

Subsequent to the kinking, the door assembly is brought by the user into the position which is shown in FIG. 2*c*.

The door leaves 1 and 2 are mounted as follows on the item of furniture 3: a first door leaf 1 is coupled on one side to a carriage 8 and is hingedly connected on the other side with a second door leaf 2. The second door leaf 2, in turn, is arranged on a carrier 29.

For transferring the door leaves 1 and 2 from the closed position shown in FIG. 1 into the position shown in FIG. 2*c*, in which the two door leaves 1 and 2 are situated in the kinked or spread-apart position, it is substantially sufficient to exert force on the first door leaf 1 as the second door leaf 2 is positively driven between the first door leaf 1 and the carrier 29.

As is apparent from FIGS. 2*a* and 2*c*, the carriage 8 is movable along a rail 7 which is oriented parallel to the plane in which the front panels of the door leaves 1 and 2 are arranged in their closed position.

The carriage 8 is formed in several parts: a vertically oriented carrier element 43 is mounted in a first module 42 which is in contact with the rail 7. Interfaces 44 and 45 for hinges 9 are provided in this carrier element 43. The first door leaf 1 can be coupled to the carriage 8 by these hinges 9.

Seen altogether, thus, this is about a folding-sliding door system.

Figure 3A:
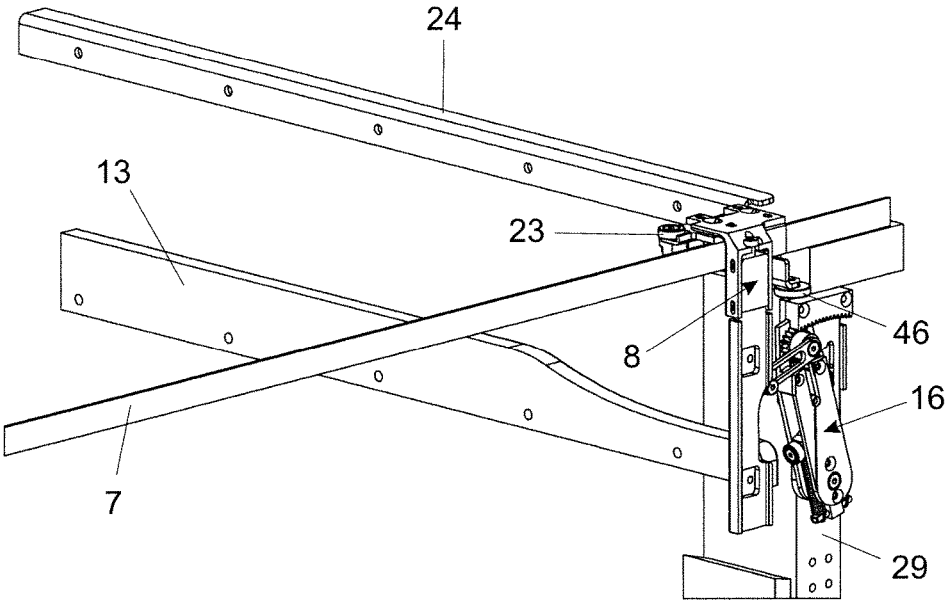
Figure 3B:
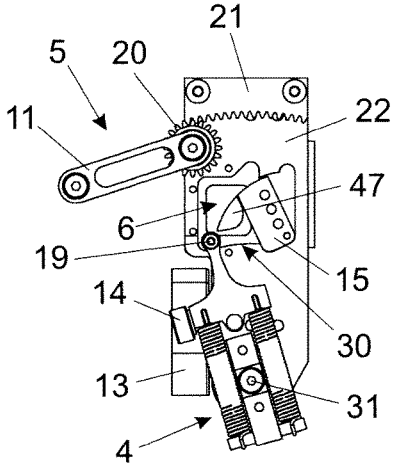
Figure 3C:
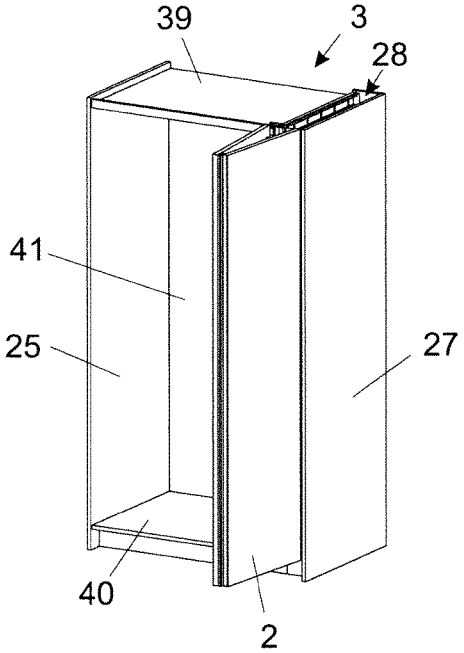

When moving the two door leaves 1 and 2 further in the direction of the folded position, the position shown in FIG. 3*c* is reached as an intermediate position. In this intermediate position, that the carriage 8—more precisely—the supporting contour 10 on the vertically arranged carrier element 43 abuts the spreading element 5.

Figure 12:
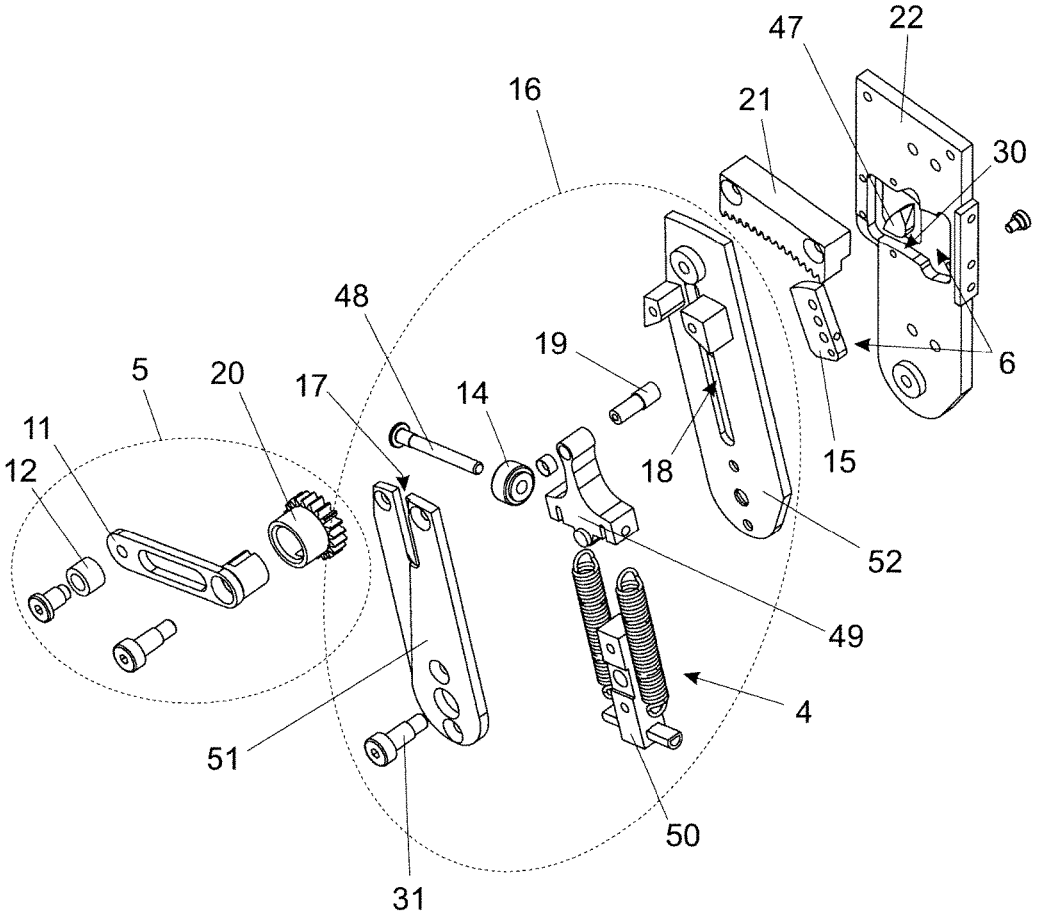
FIG. 12 shows an exploded view of the arrangement.
Figure 13A:
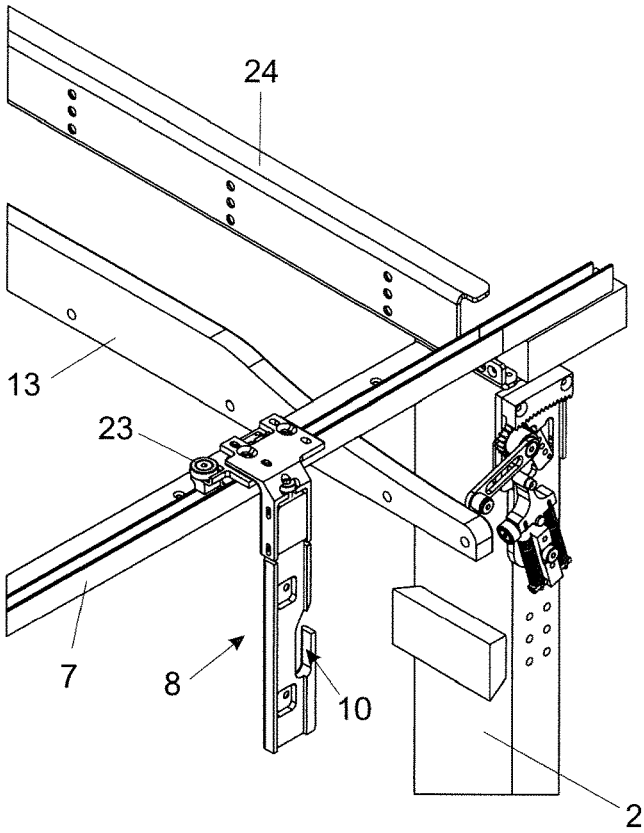
Figure 13B:
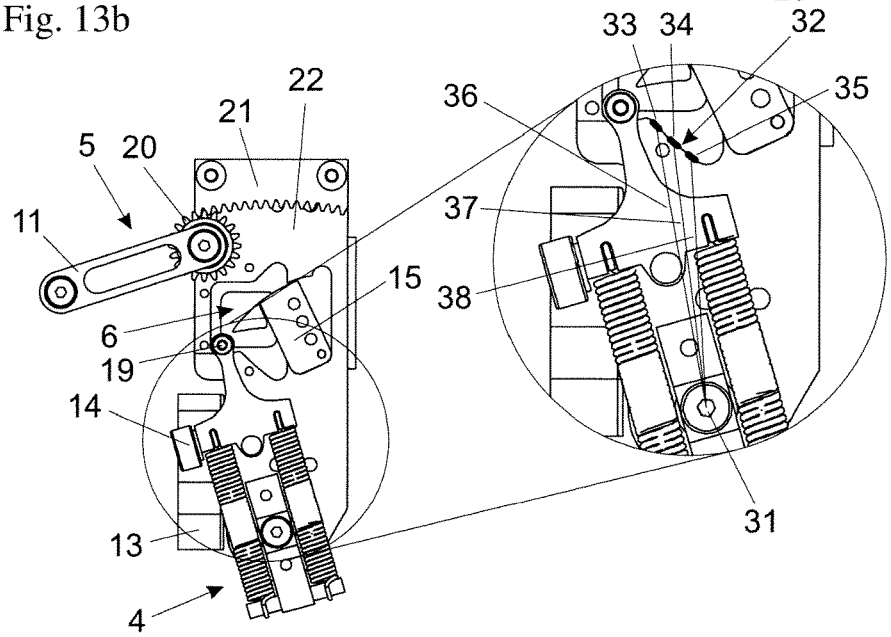
Figure 14A:
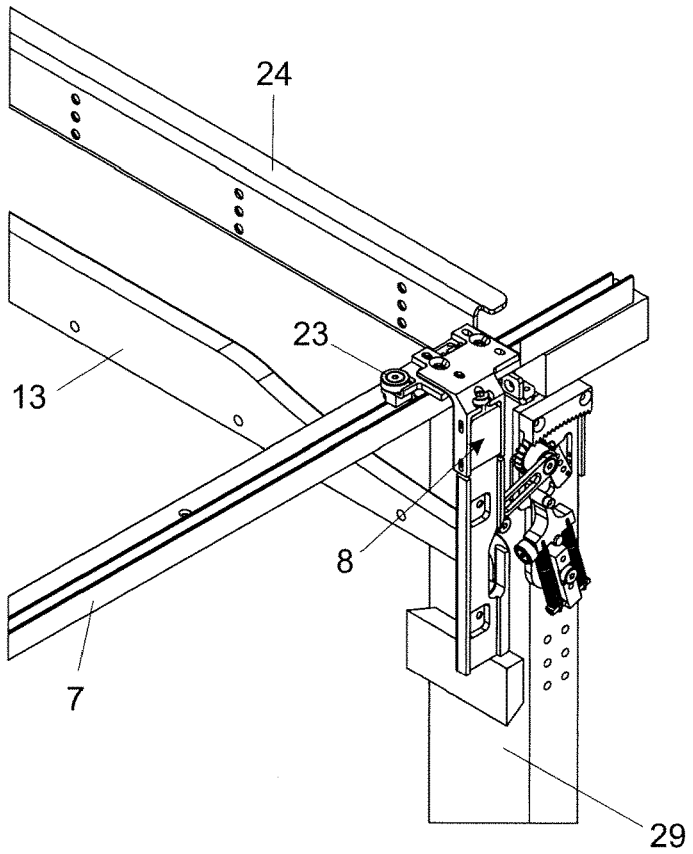
Figure 14B:
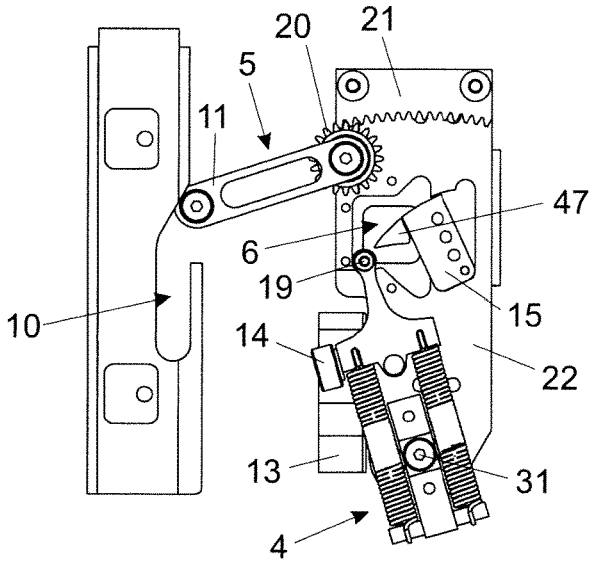
Figure 15A:
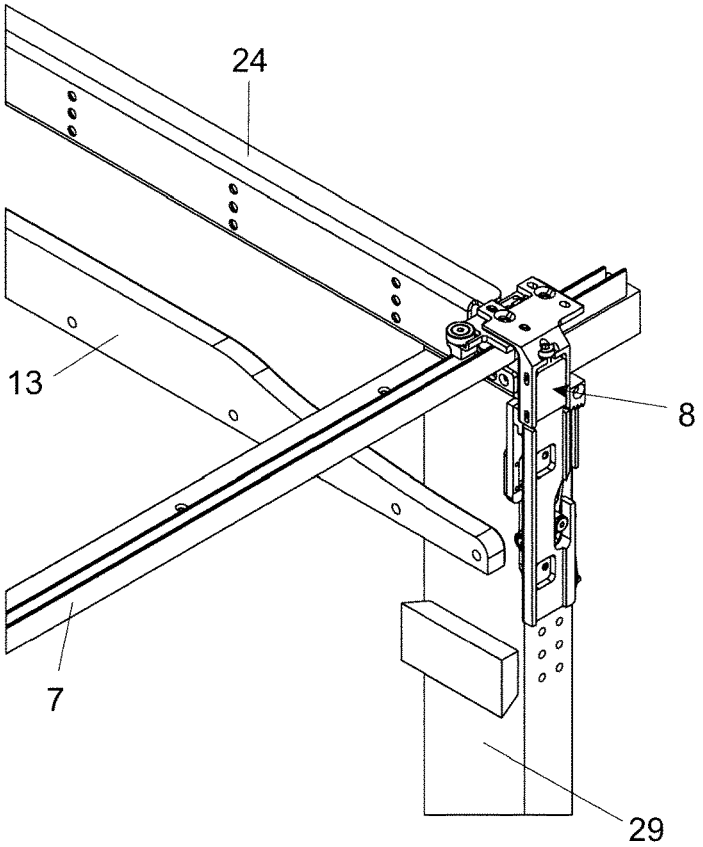
Figure 15B:
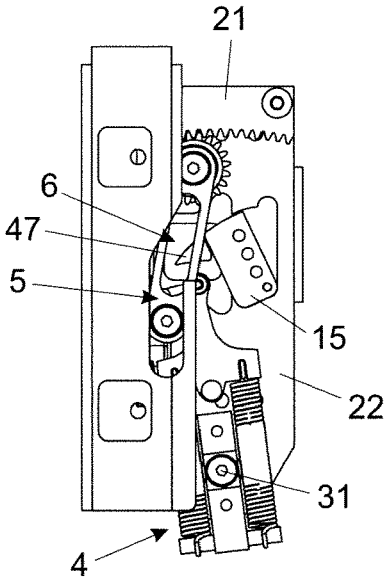
Figure 16A:
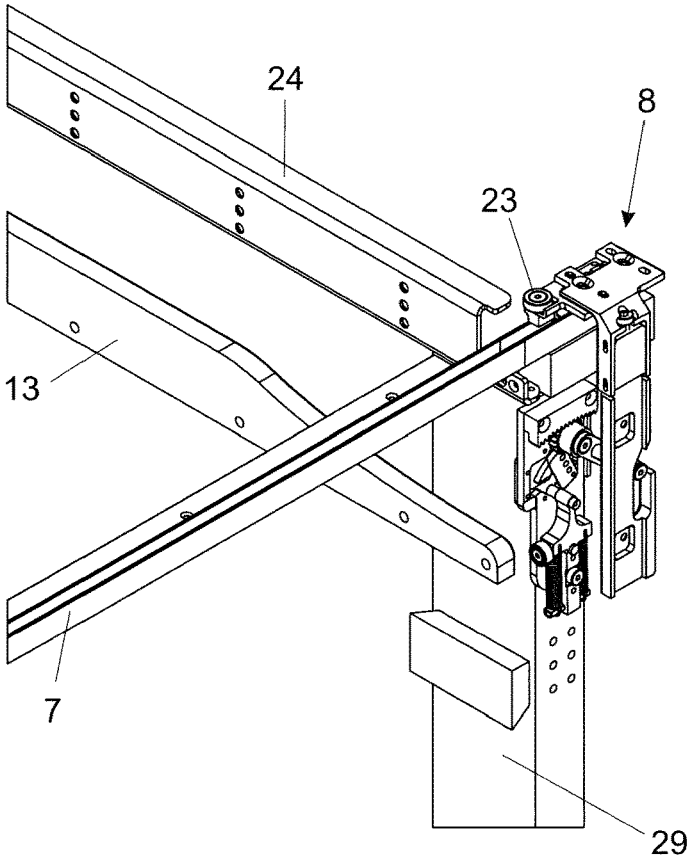
Figure 16B:
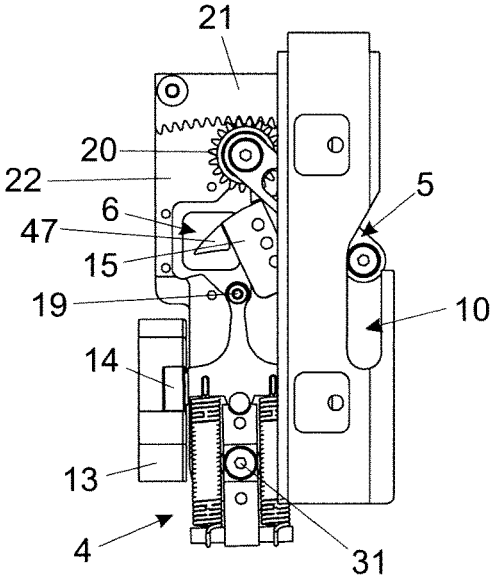
Figure 17A:
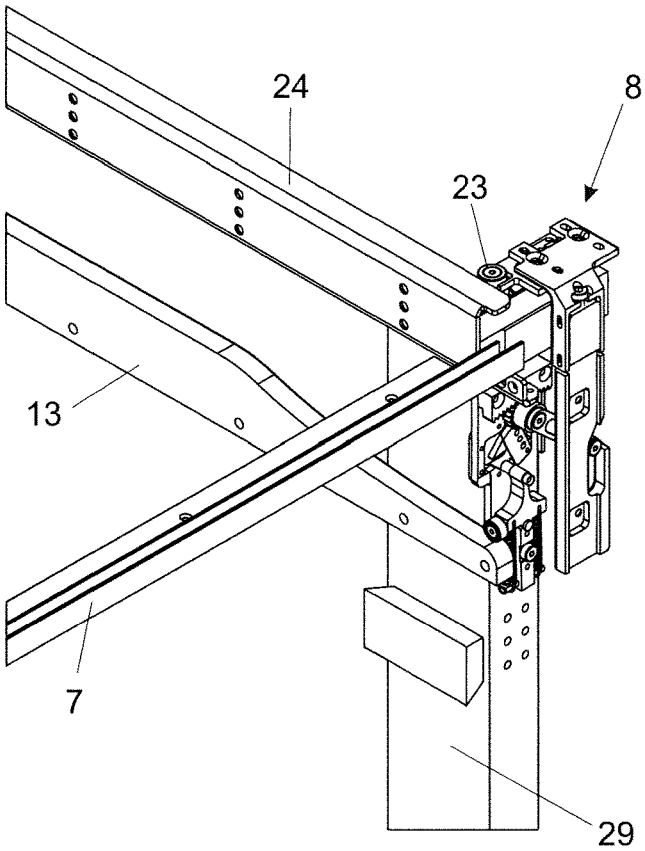
Figure 17B:
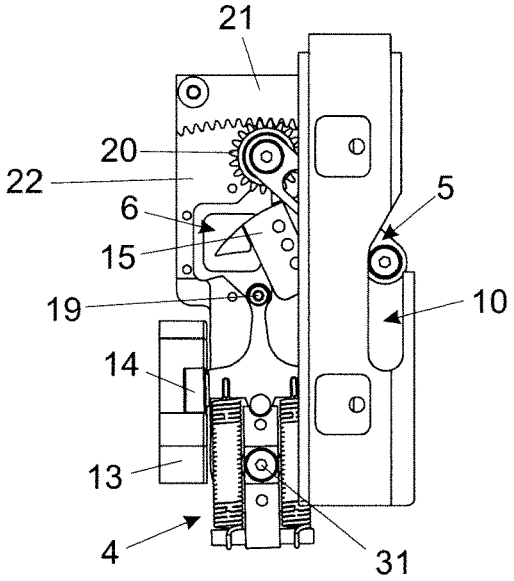
Figure 18A:
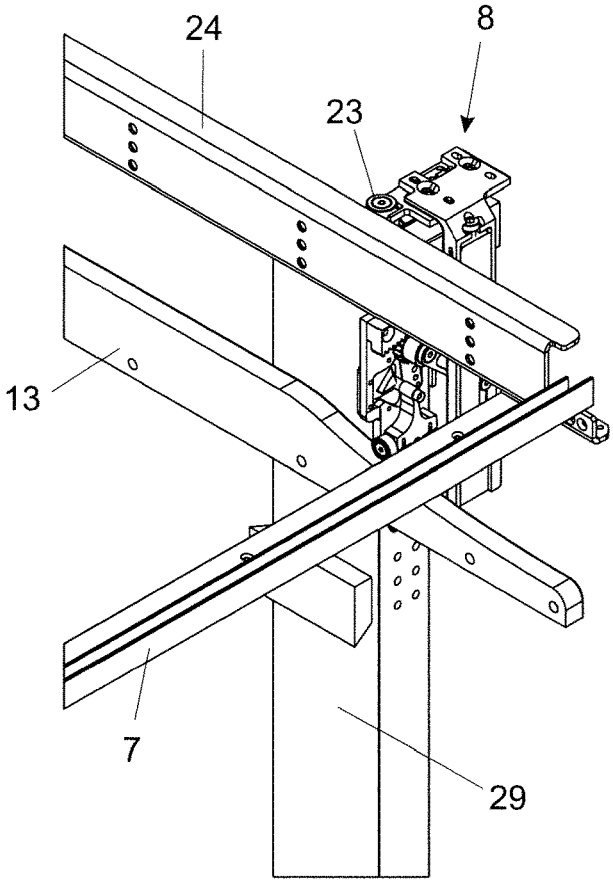
Figure 18B:
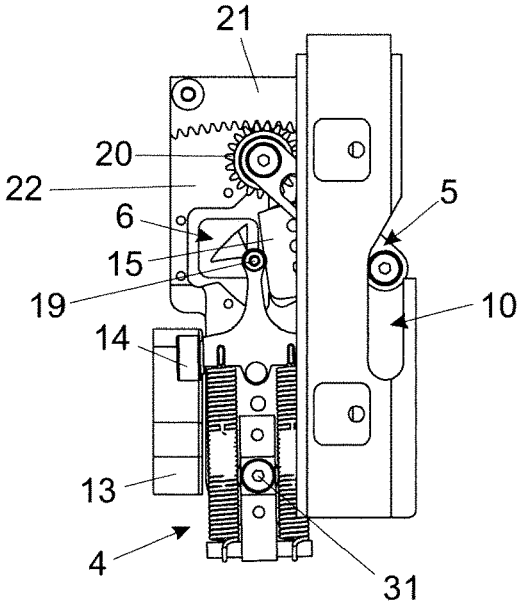
Figure 19A:
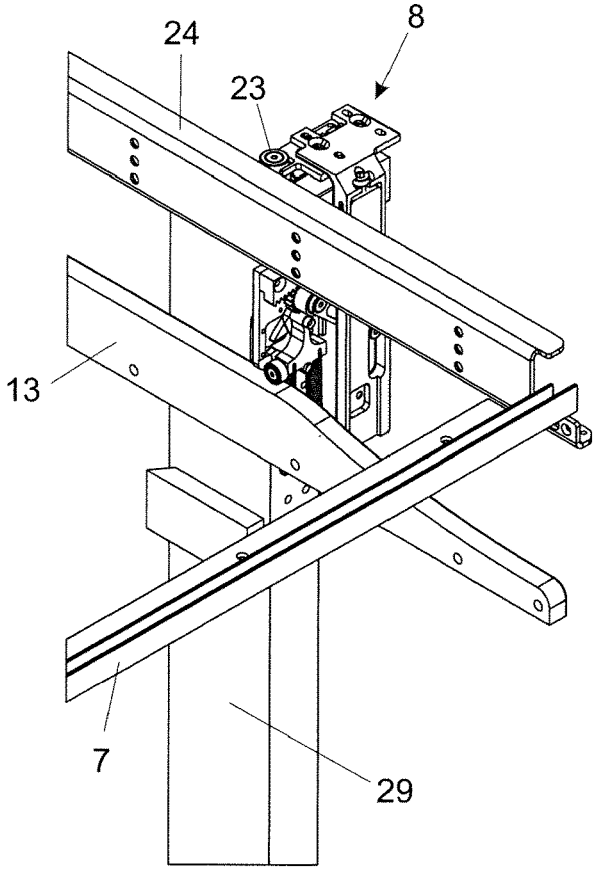
Figure 19B:
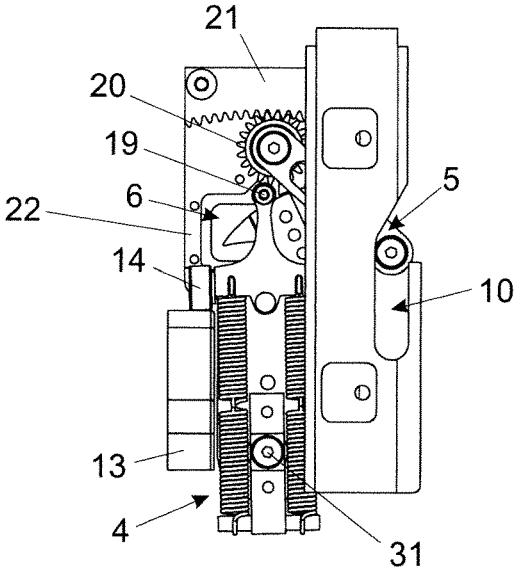
Figure 20A:
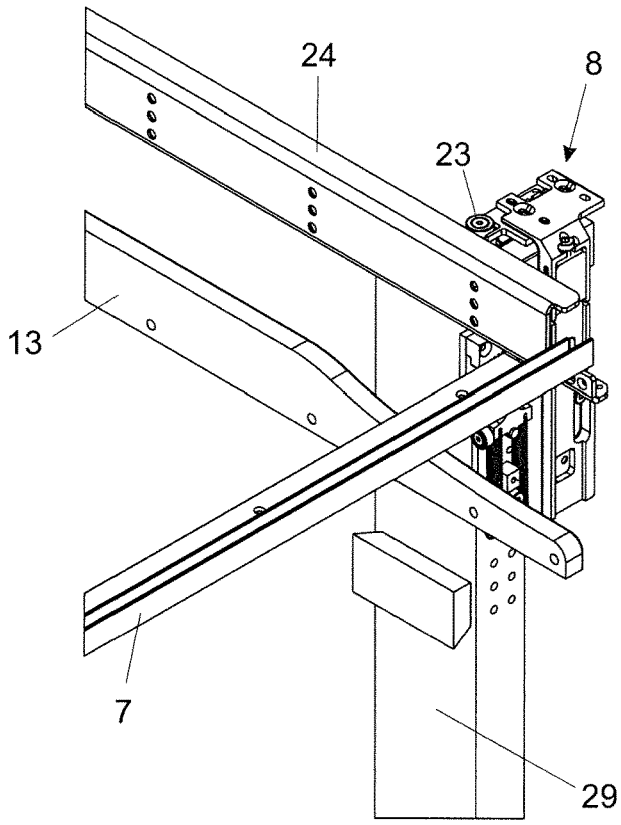
Figure 20B:
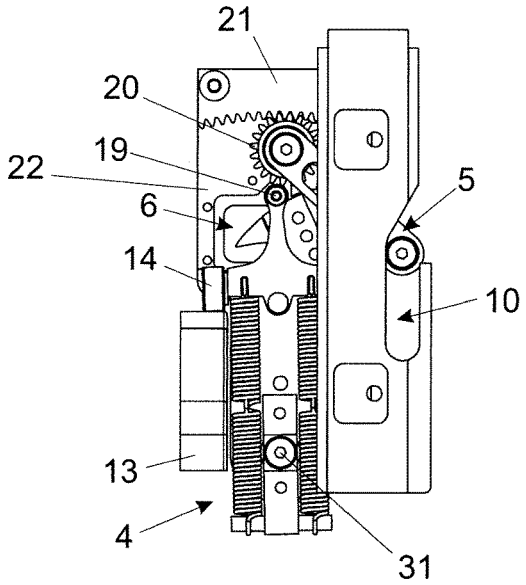
Figure 21A:
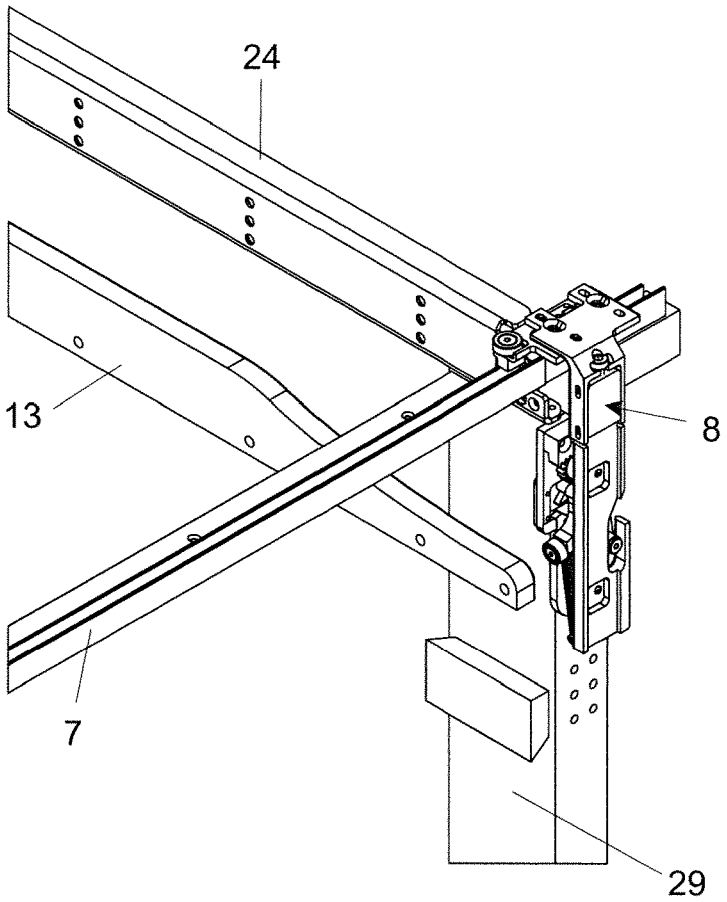
Figure 21B:
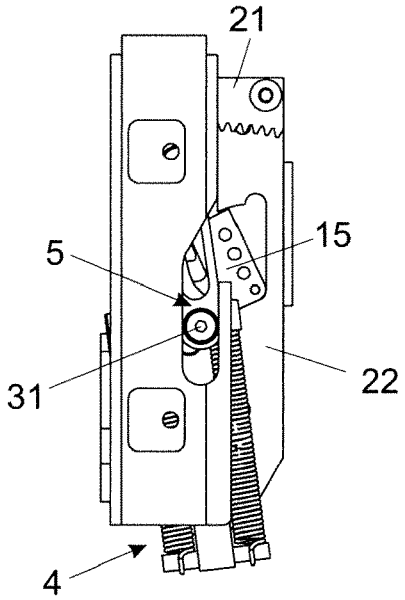
Figure 22A:
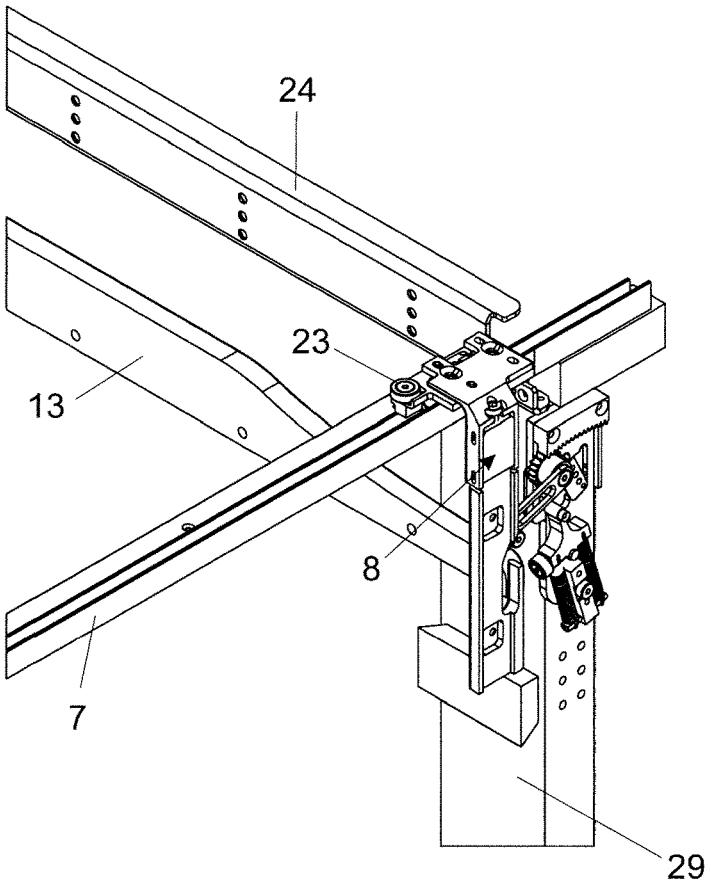
Figure 22B:
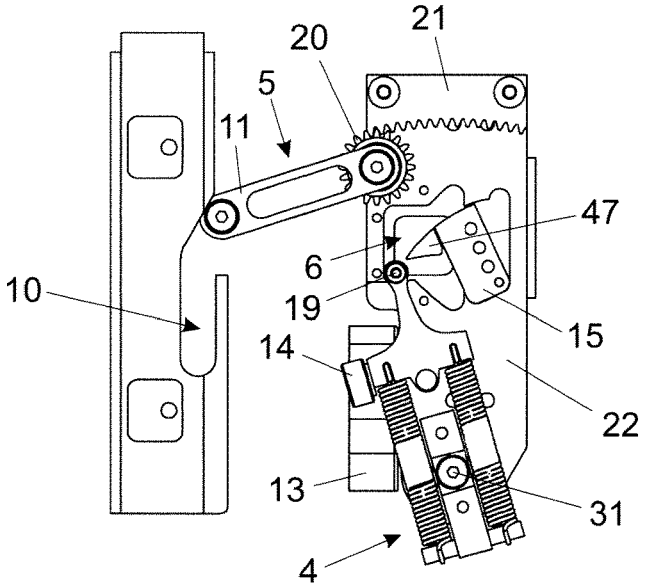
Figure 23A:
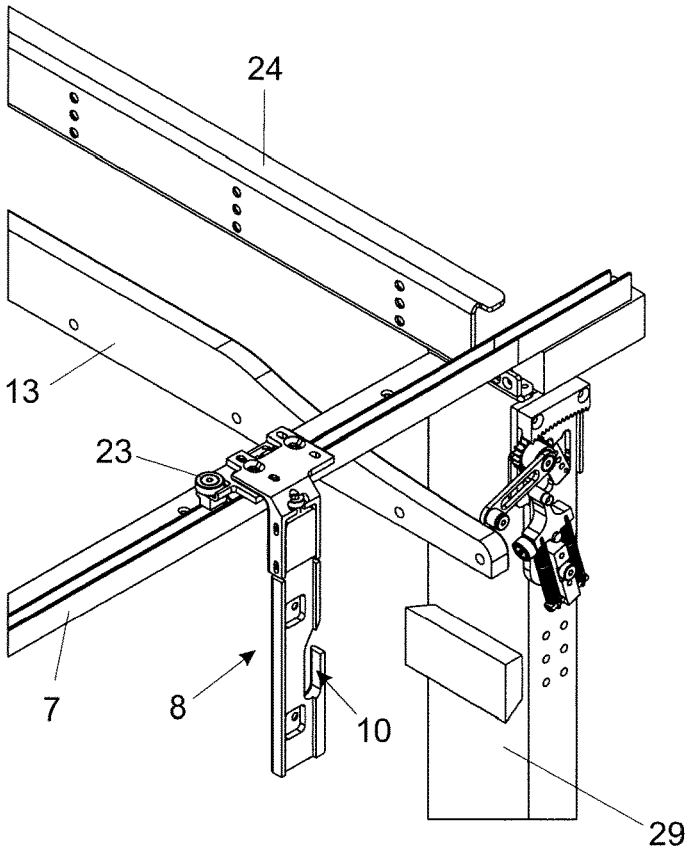
Figure 23B:
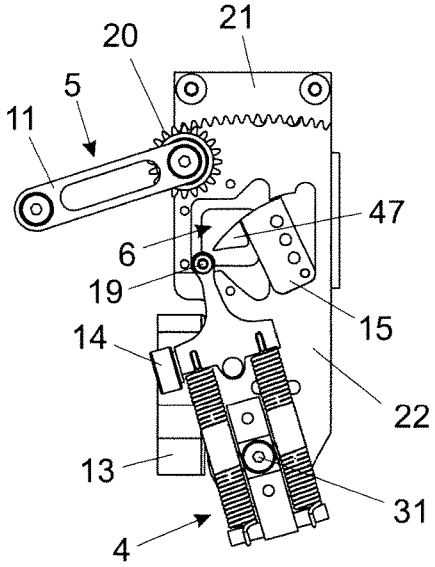

As is apparent from FIG. 12, this spreading element 5 comprises a pivotally supported lever arm 11 with a free end, wherein a pivotally supported rolling body 12 in the form of a roller is arranged on this free end. This means that the rolling body 12 contacts the supporting contour 10 for the first time when the carriage 8 impinges on the spreading element 5. Apart from that—when comparing FIGS. 2*b* and 3*b* with each other—there is not yet any change of the position of the spreading element 5 and the components connected therewith.

Generally it should be pointed out that the FIGS. 2*b*, 3*b*, 4*b*, 5*b*, 6*b*, 7*b*, 8*b*, 9*b*, 10*b*, and 11*b* each show a front view of the component group arranged on the carrier 29, wherein the front plate 51 and the back plate 52 of the swiveling element 16 (compare FIG. 12) in this view are each omitted, in order to be able to better comprehend the position of the control pin 19 in relation to the control contour 6.

Figure 4A:
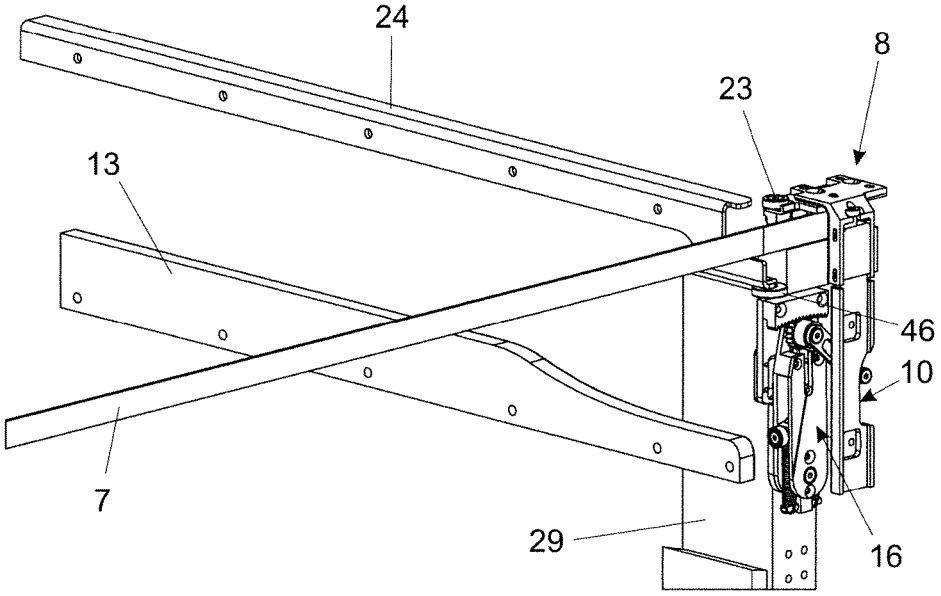
Figure 4B:
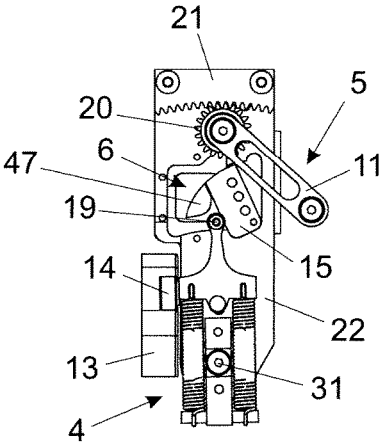
Figure 4C:
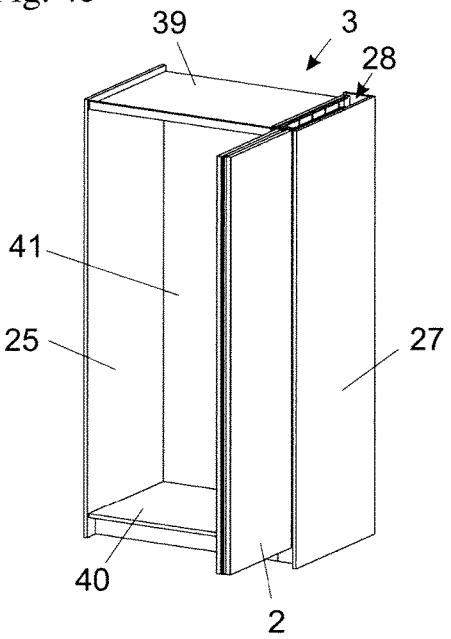

Starting from the intermediate position shown in FIG. 3*c*, the door leaves 1 and 2 are subsequently moved by the user into the folded position as is shown in FIG. 4*c*.

When comparing FIGS. 3*a* and 4*a* or 3*b* and 4*b* with each other, it is evident that in the course of this movement the lever arm 11 of the spreading element 5 is rotated counter-clockwise because the rolling body 12 abuts the supporting contour 10.

As is apparent from the exploded view according to FIG. 12, the lever arm 11 on the one hand is pivotally supported on the swiveling element 16 and on the other hand interacts via a toothed wheel 20 with a toothed rack 21 which is arranged on a base 22. On the base 22, in turn, the swiveling element 16 is pivotally supported about the pivot point 31. This means that the rotational movement of the lever arm 11—which movement is effected by the movement of the carriage 8 in the direction of the folded position of the door leaves 1 and 2—causes a clockwise pivoting of the swiveling element 16 about the pivot point 31.

Generally it should be noted that the base 22, on which the mentioned components are arranged or with which the mentioned components are connected, is mounted to the carrier 29.

When now looking at the control pin 19 which is braced on the control contour 6, so it can be discerned on the basis of a comparison of FIGS. 3*b* and 4*b* that the control pin 19 has moved along a section 30 which is formed circular in relation to the pivot point 31. This means that the distance of the control pin 19 to the pivot point 31 has remained unchanged during the movement of the door leaves 1 and 2 from the intermediate position according to FIG. 3*c* into the folded position according to FIG. 4*c*. This means further that the tension of the springs of the energy accumulator 4—as the springs were unloaded, i.e. not tensioned in the positions according to FIGS. 2*b* and 3*b*—has not changed or is still in the relaxed state in the position according to FIG. 4*b*. Hence, no loading of the energy accumulator 4 took place so far. Formulated abstractly, thus, the control contour 6 is designed in such a way that the two door leaves 1 and 2 are powerlessly transferred from the spread-apart position into the folded position.

The transition of the carriage 8 from the position according to FIG. 3*a* into the position according to FIG. 4*a* is facilitated by a guide roller 46 supported in the end section of the guide 24.

Figure 5A:
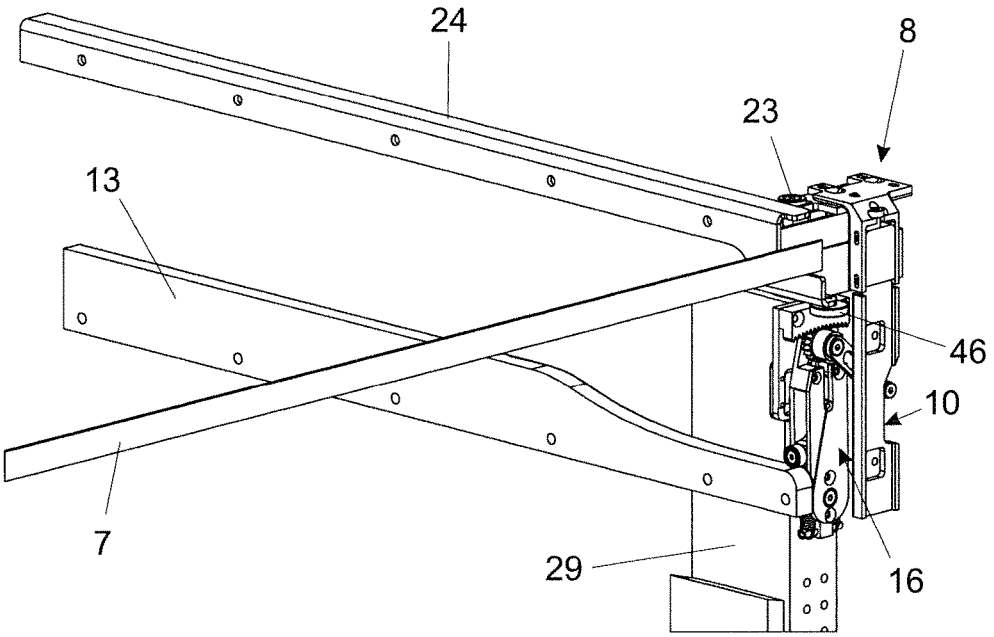
Figure 5B:
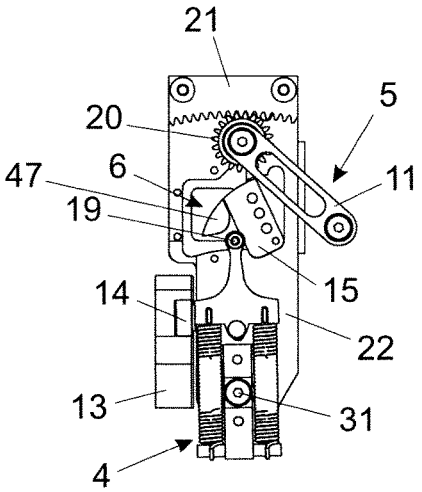
Figure 5C:
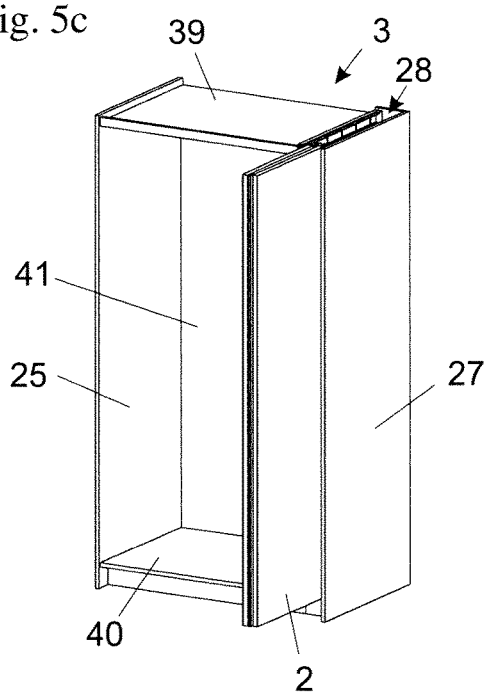
Figure 6A:
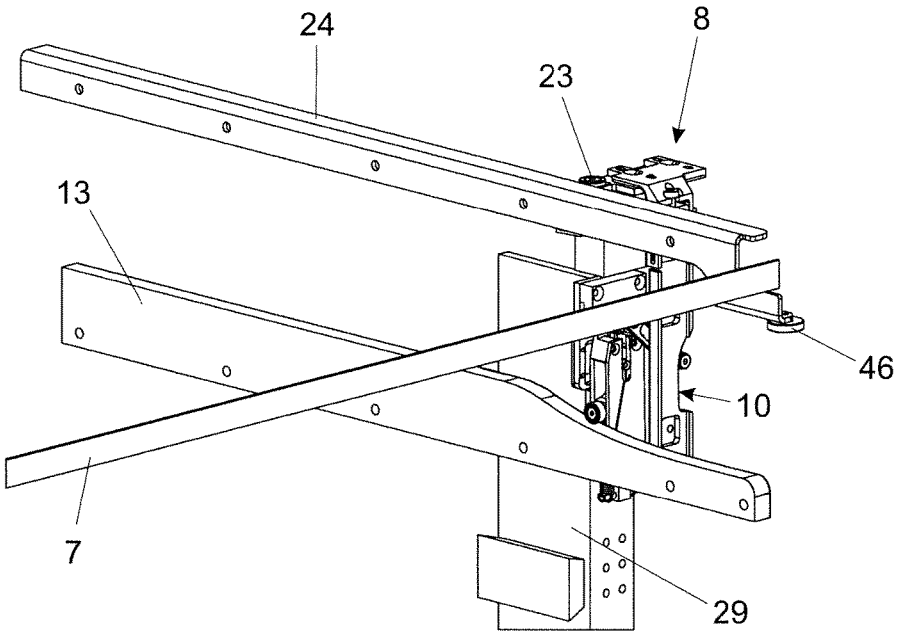
Figure 6B:
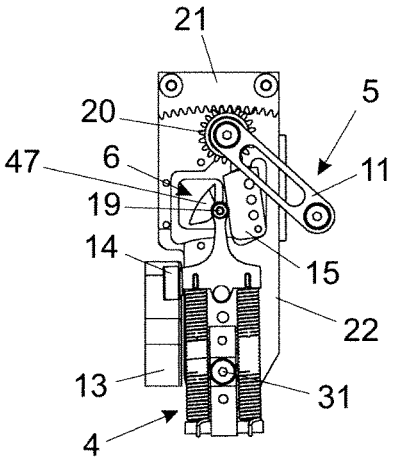
Figure 6C:
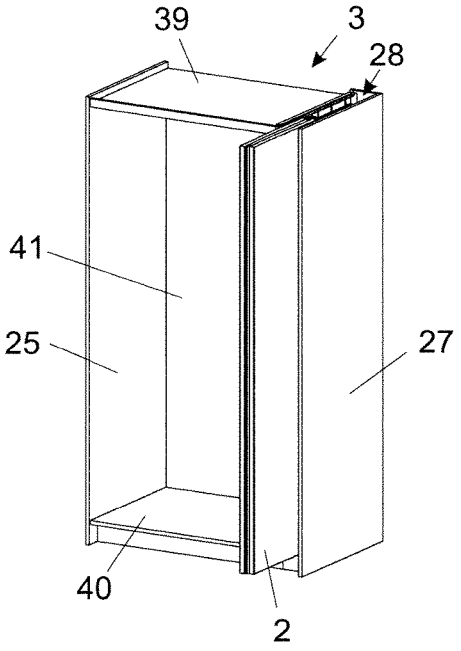
Figure 7A:
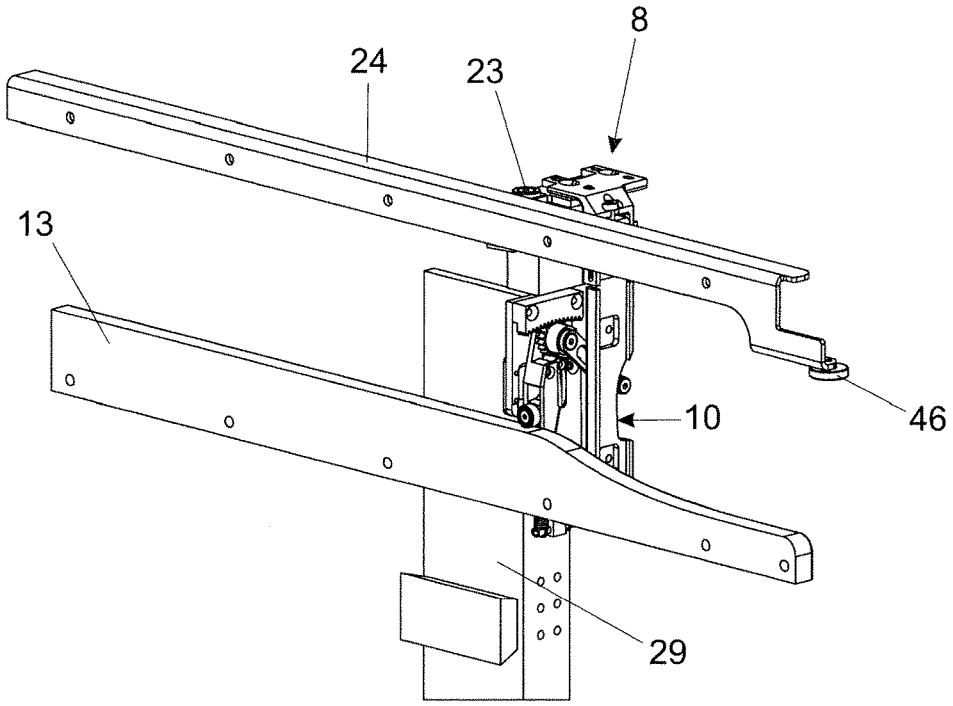
Figure 7B:
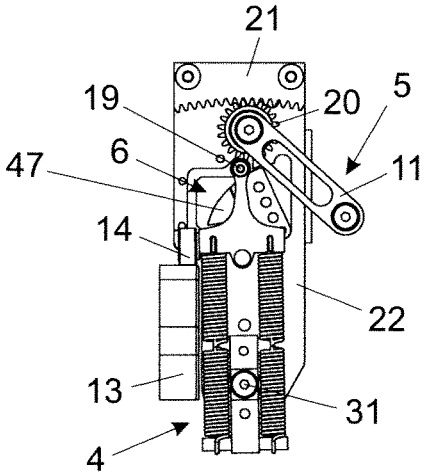
Figure 7C:
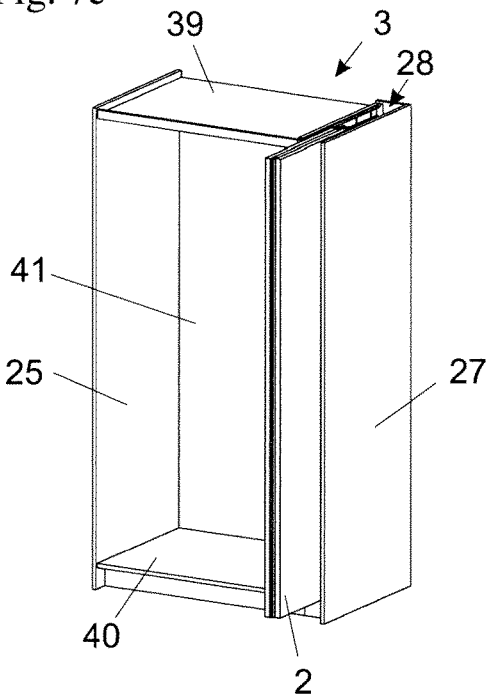
Figure 8A:
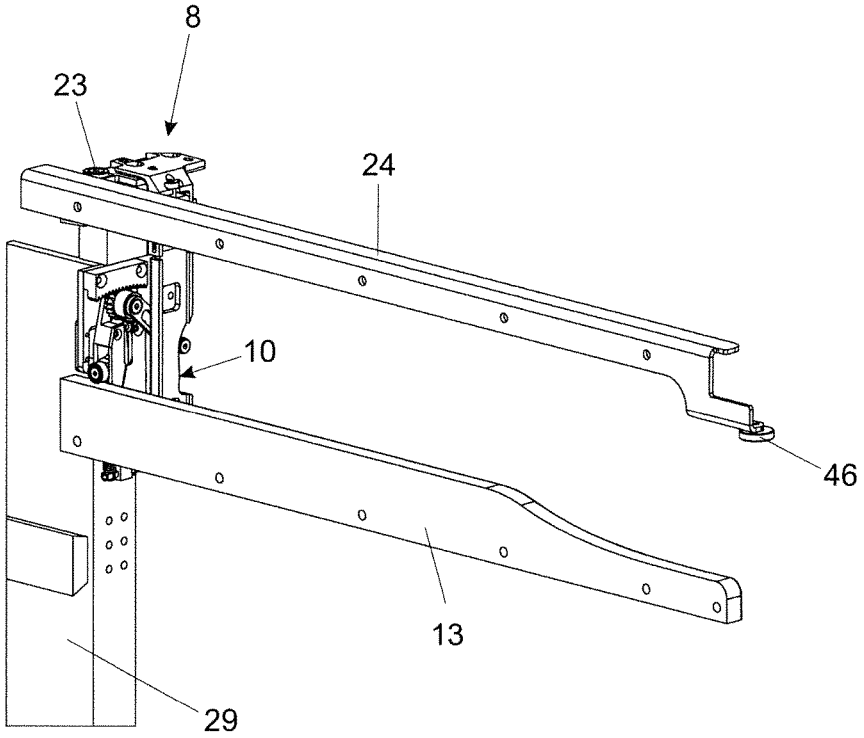
Figure 8B:
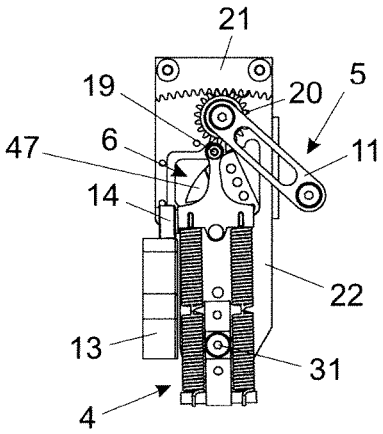
Figure 8C:
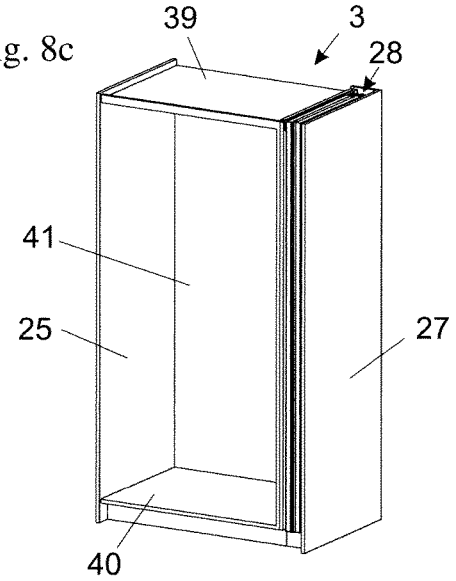

Now the inserting movement of the two door leaves 1 and 2 in their folded position begins, starting from the open position beyond the item of furniture 3 shown in FIG. 4*c*, via several intermediate positions which are shown in FIGS. 5*c*, 6*c* and 7*c*, into the fully inserted position in the item of furniture 3 which is shown in FIG. 8*c*.

In the intermediate position shown in FIG. 5*c*, the loading roll 14 impinges for the first time the loading curve 13 attached to the side wall 25 of the item of furniture 3.

It is also important that during the transition from the position according to FIG. 4*c* into the position according to FIG. 5*c* a guiding roller 23 arranged on the carriage 8 abuts the guiding rail 24 which is also oriented horizontally and which, however, in relation to the rail 7 is oriented in an angle of substantially 90°. In other words the guiding rail 24 is extending in the direction of the slot 28 of the item of furniture 3. As the carriage 8 is now supported on the guide 24 by means of the guiding roller 23, a movement of the spreading element 5 or of the lever arm 11, whose rolling body 12 is indeed supported on the supporting contour 10, is prevented. This means that there is no change of the position of the swiveling element 16 in relation to the base 22 during the insertion of the door leaf assembly into the slot 28.

Looking to FIG. 5*b*, the control pin 19 still abuts the section 30 of the control contour 6 which is formed circular in relation to the pivot point 31. Thus, the energy accumulator 4 is still unloaded.

When further moving the door leaf assembly in the direction of the inserted position in the item of furniture 3, the loading of the energy accumulator 4 takes place.

When comparing FIGS. 6*a* and 5*a* or 6*b* and 5*b* with each other, it can be discerned that the loading roll 14 is moved along an inclination of the loading curve 13. In this case, the distance of the loading curve 14 to the pivot point 31 or to the spring holder 50 on the swiveling element 16 (compare FIG. 12) increases. As Because the loading roll 14 is arranged on the pin holder 49 by the loading roll bearing 48, the distance of the pin holder 49 to the spring holder 50 on the swiveling element 16 increases. The springs of the energy accumulator are spanned between the spring holder 50 and the pin holder 49. Ultimately, the change of distance leads to a loading of the energy accumulator 4.

The control pin 19 is supported in the grooves 17 or 18 of the front plate 51 or of the back plate 52 of the swiveling element 16. During the loading process of the energy accumulator 4, the control pin 19 is therefore moved linearly upward in the grooves 17 and 18. There, the control pin 19 abuts the pivotally support contour lock 15 of the control contour 6 and moves the contour lock 15 to the sideward, as can be seen by reference to a comparison of FIGS. 6*b* and 5*b*.

In the intermediate position of the door leaves 1 and 2 in their folded position as shown in FIG. 7*c*, the loading process of the energy accumulator 4 is completed because the loading roll 14 has reached its highest point in the loading curve 13. The springs of the energy accumulator 4 are fully tensioned.

When comparing FIGS. 7*b* and 6*b* with each other, it can be discerned that the contour lock 15 has again moved into its original position after the control pin 19 has passed the contour lock 15. This means that the contour lock 15 again abuts the insular part 47 of the control contour 6. Now, the contour lock 15 blocks the way which the control pin 19 has travelled during the transition from the open position according to FIG. 5*c* into the position according to FIG. 7*c* in which the energy accumulator 4 is fully loaded. This means that the contour lock 15 allows the control pin 19 only to pass in one direction or, put in other words, that the contour lock 15 acts unidirectional.

Starting from the intermediate position, in which the energy accumulator 4 is fully loaded, to the fully inserted position of the door leaf assembly in the item of furniture 3 according to FIGS. 8*a* to 8*c* the loading roll 14 is moved along a horizontally oriented section of the loading curve 13. This means that the loading state of the energy accumulator 4 remains unchanged.

Figure 9A:
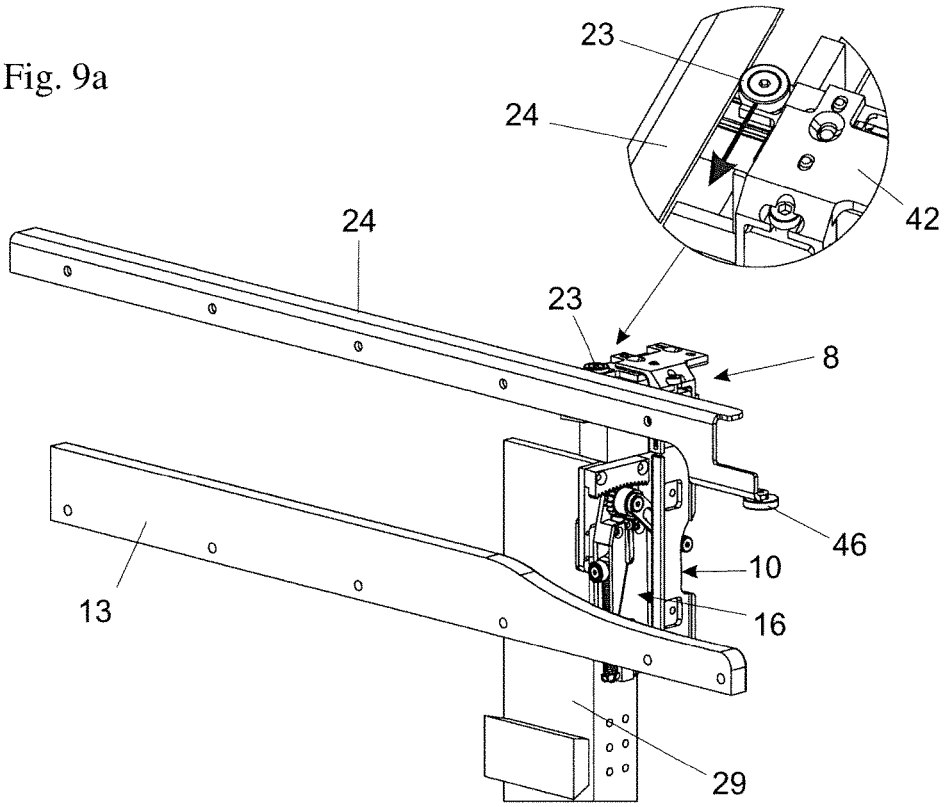
Figure 9B:
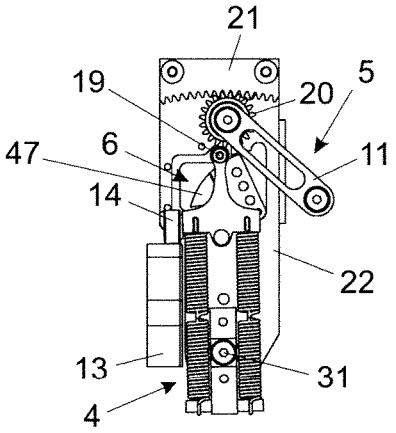
Figure 9C:
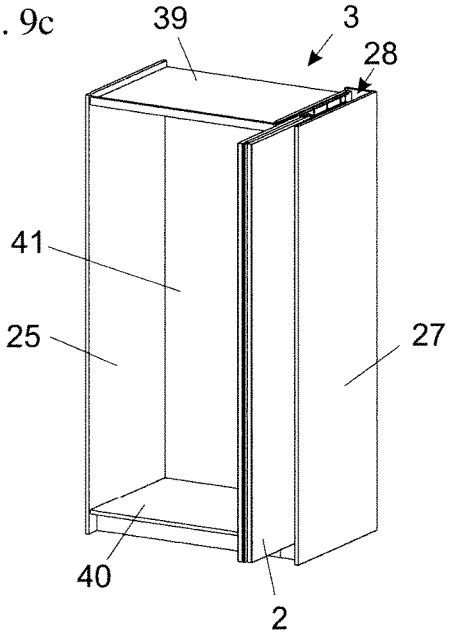
Figure 10A:
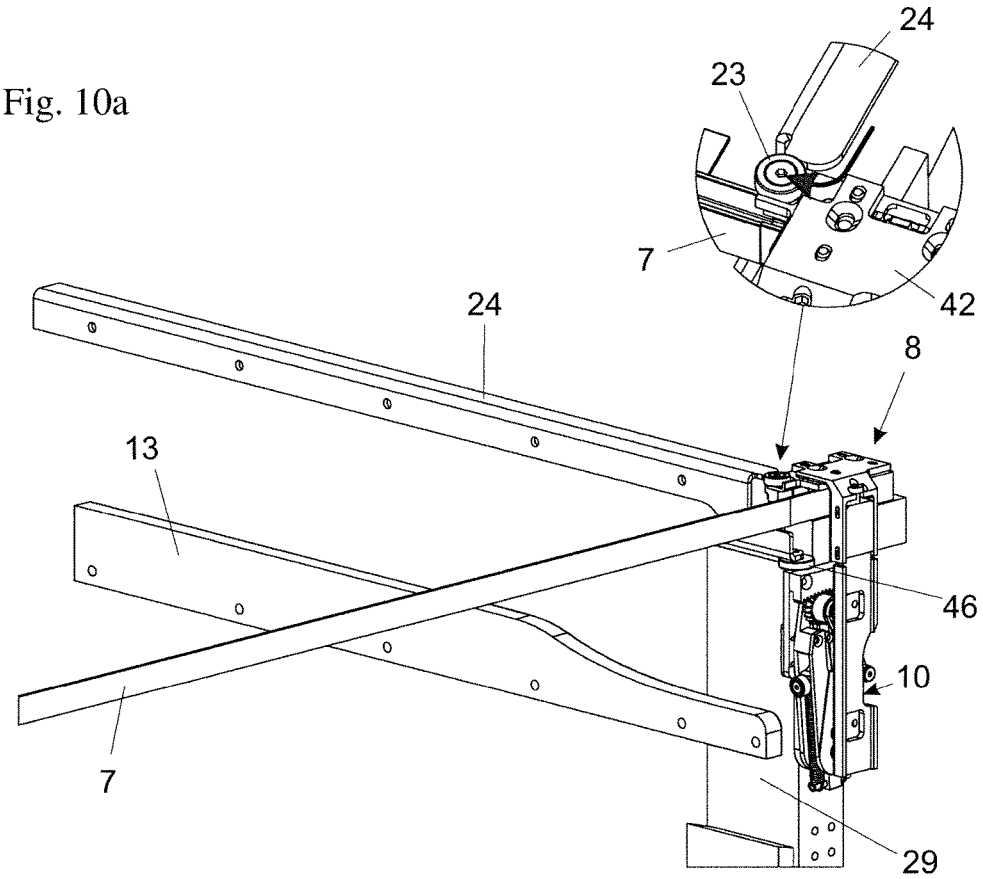
Figure 10B:
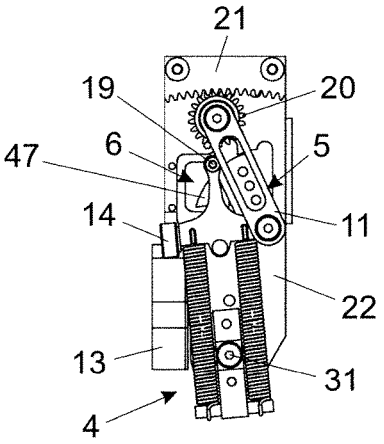
Figure 10C:
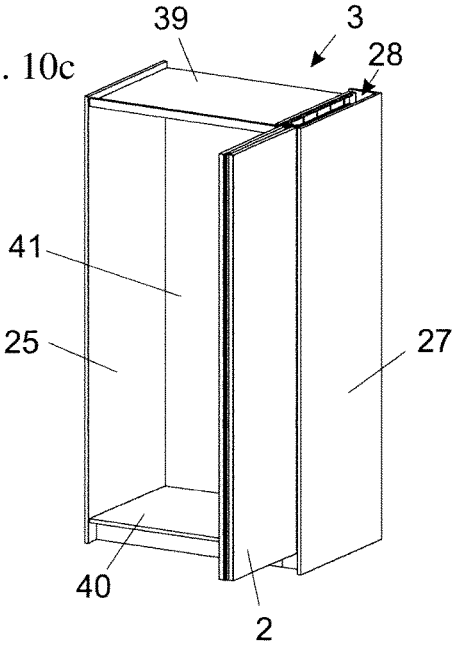
Figure 11A:
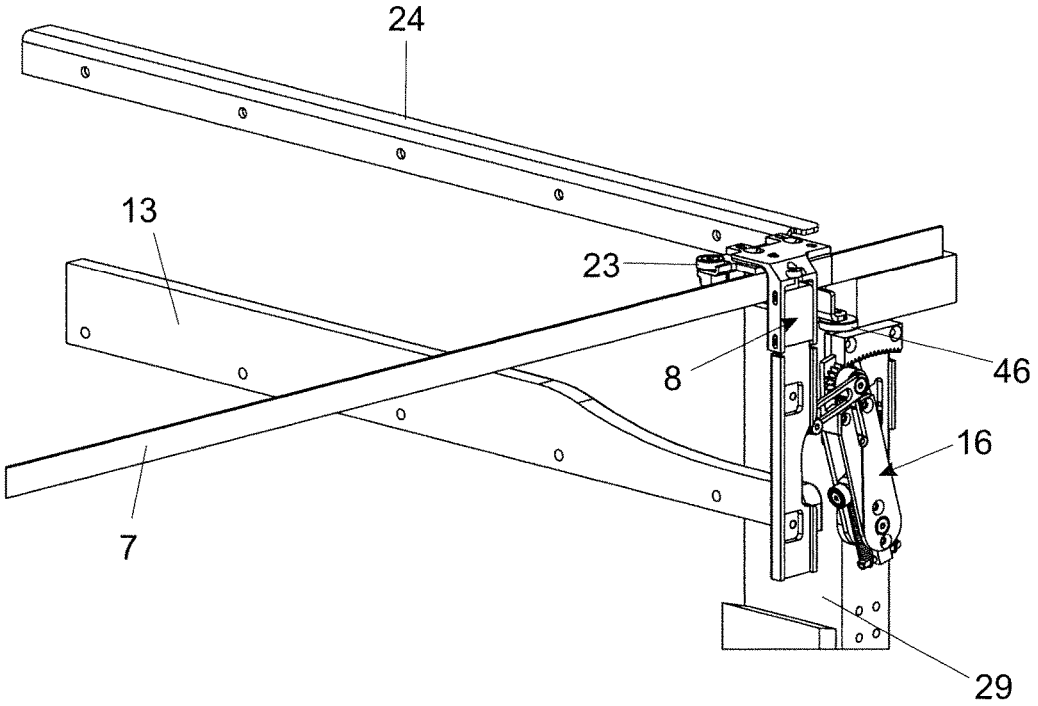
Figure 11B:
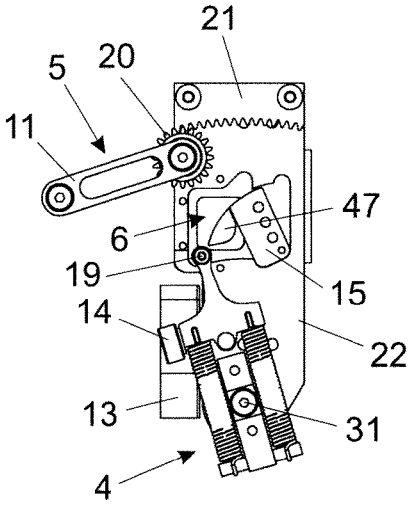
Figure 11C:
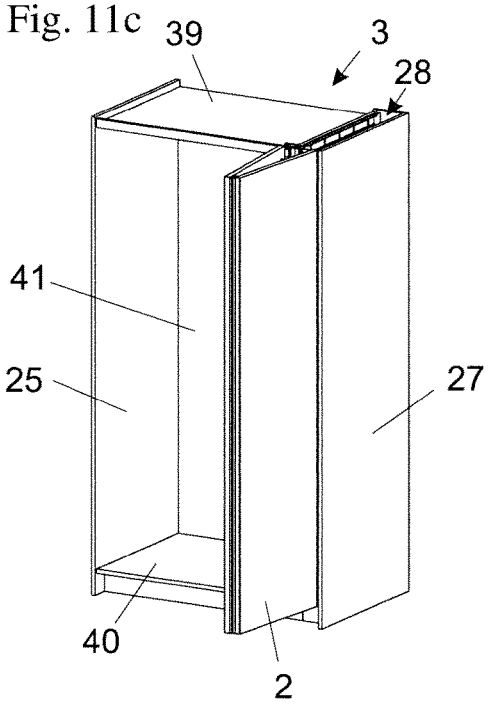

Now the movement of the door leaves 1 and 2 is performed in the reverse direction, i.e. from the inserted position in the item of furniture 3 according to FIG. 8*c* via several intermediate positions in the slot 28, from which one is shown in FIG. 9*c*, into the open position beyond the item of furniture according to FIG. 10*c* and subsequent from the folded position into the spread-apart position according to FIG. 11*c*. From this spread-apart position the door leaves 1 and 2 can then be transferred by the user into the closed position according to FIG. 1.

For the initiation of the movement of the door leaf assembly from the slot 28 an ejection device is provided which can be unlocked by pressing onto the door leaf assembly in a direction towards the back wall 41 of the furniture carcass. After the unlocking the energy stored in the ejection device is free and ejects the door leaf assembly. Advantageously this energy is so large that the door leaf assembly is fully transferred from the inserted position in the item of furniture 3 into the open position beyond the item of furniture 3.

When looking at the intermediate position of the door leaf assembly in the slot 28 shown in FIGS. 9*a* to 9*c*, it can be recognized that the energy accumulator 4 is not unloaded during the ejection from the slot 28 because on the one hand a pivoting movement of the swiveling element 16 via the carriage 8 is blocked and on the other hand the way of the control pin 19, which the control pin 19 has travelled during the loading process, is blocked by the contour lock 15. From the enlarged view from above in FIG. 9*a* of the section of the carriage 8 with the guiding roll 23 it can be seen that the guiding roll 23 braces on the guiding rail 24 and, thus, indirectly blocks a movement of the spreading element 5 under the impingement of the loaded energy accumulator 4.

This blocking effect ends as soon as the guiding roll 23 has reached the end of the guide 24 (compare FIGS. 10*a* to 10*c*). In this moment the lever arm 11 starts to rotate clockwise under the effect of the loaded energy accumulator 4 and thereby accelerates the carriage 8, wherein the rolling body 12 arranged on the free lever end is supported on the supporting contour 10 of the carriage 8. By the movement of the carriage 8 in the direction of the rail 7 the first door leaf 1 is spread apart in relation to the second door leaf 2. During the pivoting of the swiveling element 16 the control pin 19 is initially moved along the outer contour of the contour lock 15 and then along the insular part 47 of the control contour 6. Both of these areas together form a curved section which is designed in such a way that the force stored in the energy accumulator 4 is released dosed. This means that the force is not suddenly free, but a dosed force transmission onto the carriage 8 and onto the door leaf 1 coupled therewith takes place.

FIGS. 11*a* to 11*c* show the end position of the lever arm 11 of the spreading element 5 in which the energy accumulator is again fully loaded (compare FIGS. 2*a* through 3*b*). Depending on the weight of the door leaves 1 and 2 the carriage 8 and, thus, the door leaf 1 coupled with this carriage 8 moves still a bit further. However, as the carriage 8 does not receive further driving force, the carriage 8 decelerates and finally comes to a halt. Then the door leaves 1 and 2 have approximately a position as shown in FIG. 2*c*. Starting from this position the user can manually transfer the door leaves 1 and 2 into the closed position according to FIG. 1.

FIGS. 13*a* to 23*b* show a second advantageous embodiment of the invention. The operational sequence substantially corresponds to the operational sequence which is shown in FIGS. 2*a*-11*c*.

The substantial difference between the first and the second embodiment is that the energy accumulator 4 is not fully unloaded in the starting position of the spreading element 5 according to FIGS. 13*a* through 14*b*.

When the carriage 8 impinges on the lever 11 of the spreading element 5, the rolling body 12 supported on the free lever end catches behind a protrusion on the supporting contour 10.

When moving the door leaves 1 and 2 from the spread-apart position into the folded position, the control pin 19 further moves along a section 32 which is composed of segments whose distances to the pivot point 31 are getting successively smaller. Three of these segments 33, 34 and 35 are exemplary shown in the enlarged view of FIG. 13*b* together with their distances 36, 37 and 38 to the pivot point 31.

If the control pin 19 is now moved along this section 32 (compare the transition from FIG. 14*b* via the intermediate position 15*b* into the end position 16*b*), the rest energy in the energy accumulator 4 is released and is transmitted to the spreading element 5 which, as it is caught on the carriage 8, actively pulls the carriage 8 into the folded position. Formulated abstractly, the control contour 6 is designed in such a way that, starting from the spread-apart position, by the spreading element 5 a force can be exerted in the direction towards the folded position onto at least one of the at least two door leaves 1 and 2.

The further operational sequence substantially corresponds to the operational sequence described in the course of the description of the first embodiment.

The invention claimed is:

1. An arrangement for spreading apart at least two door leaves which are part of an item of furniture and are hingedly interconnected, from a folded position into a spread-apart position, said arrangement comprising:

an energy accumulator;

a spreading element impinged by the energy accumulator, the spreading element including a pivotally supported lever arm with a free end;

a control contour for controlling a movement of the spreading element; and an ejection device for ejecting the at least two door leaves in the folded position from an inserted position in the item of furniture into an open position beyond the item of furniture, and the inserted position is formed in a slot of the item of furniture.

2. The arrangement according to claim 1, wherein the control contour is configured such that the at least two door leaves are powerlessly transferred from the spread-apart position into the folded position.

3. The arrangement according to claim 1, wherein the control contour is configured such that, starting from the spread-apart position, a force is exerted in the direction towards the folded position onto at least one of the at least two door leaves by the spreading element.

4. The arrangement according to claim 1, wherein the control contour comprises a contour lock configured to act unidirectional.

5. The arrangement according to claim 4, wherein the contour lock is pivotally supported.

6. The arrangement according to claim 1, further comprising a movable carriage to be coupled with at least one of the at least two door leaves.

7. The arrangement according to claim 6, wherein the carriage comprises a supporting contour for supporting the spreading element.

8. The arrangement according to claim 6, wherein the carriage is movable along at least one horizontally arranged rail, and is coupled with at least one of the at least two door leaves by a hinge.

9. The arrangement according to claim 1, further comprising a pivotally supported rolling body arranged on the free end of the pivotally supported lever arm.

10. The arrangement according to claim 1, wherein the spreading element is arranged on a swiveling element comprising a guiding groove for guiding a control pin interacting with the control contour.

11. The arrangement according to claim 1, wherein the spreading element is coupled with a base by a toothing.

12. The arrangement according to claim 11, wherein the base is attached on a carrier for the at least two door leaves, and the control contour is formed on the base.

13. The arrangement according to claim 1, wherein the energy accumulator is configured to be loaded by a movement of the at least two door leaves in the folded position.

14. The arrangement according to claim 1, further comprising a loading curve for loading the energy accumulator, and the energy accumulator is coupled with the loading curve.

15. The arrangement according to claim 14, wherein the loading curve is to be attached on a side wall of the item of furniture, and the energy accumulator is coupled with the loading curve by a loading roll.

16. The arrangement according to claim 1, wherein the energy accumulator comprises a spring assembly.

17. An item of furniture comprising:

at least two hingedly interconnected door leaves configured to be situated at least in a folded position and in a spread-apart position, and the arrangement for spreading apart the door leaves from the folded position into the spread-apart position according to claim 1.

18. The arrangement according to claim 1, wherein the ejection device is configured to eject the at least two door leaves in the folded position from a fully-inserted position in the item of furniture into the open position.

19. The arrangement according to claim 1, wherein the slot of the item of furniture is laterally arranged.

20. An arrangement for spreading apart at least two door leaves which are part of an item of furniture and are hingedly interconnected, from a folded position into a spread-apart position, said arrangement comprising:

an energy accumulator;

a spreading element impinged by the energy accumulator, the spreading element including a pivotally supported lever arm with a free end; and a control contour for controlling a movement of the spreading element, the control contour being configured such that the at least two door leaves are powerlessly transferred from the spread-apart position into the folded position, the control contour comprising a section formed circular in relation to a pivot point.

21. An arrangement for spreading apart at least two door leaves which are part of an item of furniture and are hingedly interconnected, from a folded position into a spread-apart position, said arrangement comprising:

an energy accumulator;

a spreading element impinged by the energy accumulator, the spreading element including a pivotally supported lever arm with a free end; and a control contour for controlling a movement of the spreading element, the control contour being configured to exert a force by the spreading element in a direction towards the folded position onto at least one of the at least two door leaves starting from the spread-apart position, the control contour comprising a section composed of segments, wherein the distances of these segments are successively smaller toward a pivot point.

22. An arrangement for spreading apart at least two door leaves which are part of an item of furniture and are hingedly interconnected, from a folded position into a spread-apart position, said arrangement comprising:

an energy accumulator;

a spreading element impinged by the energy accumulator, the spreading element including a pivotally supported lever arm with a free end;

a movable carriage to be coupled with at least one of the at least two door leaves; and a control contour for controlling a movement of the spreading element, wherein the carriage is configured to block a movement of the spreading element, and the carriage is supported on a guide.

23. The arrangement according to claim 22, wherein the carriage is movable along at least one horizontally arranged rail, and is coupled with at least one of the at least two door leaves by a hinge, the carriage being supported on the guide by a guiding roller.

* * * * *